US012714232B2

(12) United States Patent
Zeng

(10) Patent No.: US 12,714,232 B2
(45) Date of Patent: Aug. 25, 2026

(54) ADJUSTABLE BED

(71) Applicants: Huizhou Flex Smart Furniture Co., Ltd., Huizhou (CN); Depeng Zeng, Huizhou (CN); Wenhao Zeng, Huizhou (CN)

(72) Inventor: Guohong Zeng, Huizhou (CN)

(73) Assignees: Huizhou Flex Smart Furniture Co., Ltd., Huizhou (CN); Depeng Zeng, Huizhou (CN); Wenhao Zeng, Huizhou (CN)

( * ) Notice: Subject to any disclaimer, the term of this patent is extended or adjusted under 35 U.S.C. 154(b) by 0 days.

(21) Appl. No.: 18/898,997

(22) Filed: Sep. 27, 2024

(65) Prior Publication Data

US 2025/0017387 A1 Jan. 16, 2025

(30) Foreign Application Priority Data

Aug. 9, 2024 (CN) ..... 202421922023.3

(51) Int. Cl.
*A47C 20/04* (2006.01)

(52) U.S. Cl.
CPC ..... *A47C 20/041* (2013.01)

(58) Field of Classification Search
CPC ..... A47C 19/12; A47C 17/86; A47C 20/041; A47C 20/04; A47C 20/08; A47C 19/021; A61G 7/015
See application file for complete search history.

(56) References Cited

U.S. PATENT DOCUMENTS

| | | | | |
|---|---|---|---|---|
| 10,285,508 | B2 * | 5/2019 | Rose | A47C 20/041 |
| 2008/0262657 | A1 * | 10/2008 | Howell | A47C 20/041 700/275 |
| 2016/0095772 | A1 | 4/2016 | Cole | |
| 2017/0325592 | A1 * | 11/2017 | Suh | A47C 17/04 |
| 2019/0298074 | A1 * | 10/2019 | Dan-On | A61G 7/018 |
| 2020/0187662 | A1 * | 6/2020 | Zeng | A47C 19/122 |
| 2020/0214462 | A1 * | 7/2020 | Wang | A47C 19/122 |
| 2021/0368993 | A1 | 12/2021 | Wang et al. | |
| 2023/0200550 | A1 * | 6/2023 | Wang | A47C 19/005 5/618 |
| 2023/0404275 | A1 | 12/2023 | Wang et al. | |

* cited by examiner

*Primary Examiner* — Fredrick C Conley
(74) *Attorney, Agent, or Firm* — Hemisphere Law, PLLC

(57) ABSTRACT

The present disclosure provides an adjustable bed, including: a middle connecting bed plate, wherein a first bed frame and a second bed frame are fixedly mounted at a bottom of the middle connecting bed plate. According to the adjustable bed provided by the present disclosure, by the arrangement of the at least two groups of first movable bed plates arranged side by side and the at least two groups of second movable bed plates arranged side by side, and due to the independent adjustment on inclination angles of each group of first movable bed plates and each group of second movable bed plates, the adjustable bed can use needs of at least two persons at the same time, and has good practicality.

8 Claims, 9 Drawing Sheets

ADJUSTABLE BED

TECHNICAL FIELD

The present disclosure relates to the technical field of household supplies, and in particular, to an adjustable bed.

BACKGROUND

"Bed" originally means a utensil for people to sit or lie down, and is derived to a utensil or a place like a bed. Later, "bed" is evolved into furniture that is a place for people to lie down for sleeping.

Chinese patent No. CN107405004A discloses an adjustable bed (10) with zero wall clearance and a zero-gravity function. The bed includes a frame (20), an adjustable mattress supporting platform (11), and an actuator device (52). The mattress supporting platform (11) is provided with a plurality of hinged supporting portions (12, 16, 18); the plurality of hinged supporting portions (12, 16, 18) are pivotally mounted relative to each other for relative angle adjustment; and the actuator device (52) is configured to achieve coordinated movement of the supporting portions to reconstruct the bed between a flat lowered configuration and a raised configuration for supporting a user in a zero-gravity leaning position. The actuator device includes a single actuator, preferably, including a single linear actuator.

Although the adjustable bed mentioned above can solve the corresponding technical problems, it is difficult for the adjustable bed to meet the different use needs of at least two persons at the same time. As a result, the practicability is reduced.

Therefore, an adjustable bed is proposed.

SUMMARY

The present disclosure provides an adjustable bed to solve the problems in the background section.

Specific technical solutions are as follows:

An adjustable bed includes:

a middle connecting bed plate, wherein a first bed frame and a second bed frame are fixedly mounted at a bottom of the middle connecting bed plate, and the second bed frame and the first bed frame form a square framework;

at least two groups of first movable bed plates arranged side by side are mounted at an upper part of the first bed frame; one end of each first movable bed plate is hinged to the middle connecting bed plate; a first angle adjustment driver is hinged between a bottom of each first movable bed plate and the bottom of the middle connecting bed plate;

at least two groups of second movable bed plates arranged side by side are mounted at an upper part of the second bed frame; one end of each second movable bed plate is hinged to the middle connecting bed plate; and a second angle adjustment driver is hinged between a bottom of each second movable bed plate and the bottom of the middle connecting bed plate.

As a preferred solution of the present disclosure, the first angle adjustment driver includes a first electric push rod; a far end of a piston rod of the first electric push rod is hinged with a connecting seat I; one end of a cylinder body of the first electric push rod is hinged with a connecting seat II; one end of the connecting seat I away from the first electric push rod is fixedly connected to a middle part of each first movable bed plate; and one end of the connecting seat II away from the first electric push rod is fixedly connected to the bottom of the middle connecting bed plate.

As a preferred solution of the present disclosure, each second movable bed plate is of a foldable structure, and each second movable bed plate includes a supporting frame I and a supporting frame II; one end of the supporting frame I is hinged to the middle connecting bed plate; one end of the supporting frame II is hinged to the other end of the supporting frame I; a position, close to the other end of each supporting frame II, is hinged with two symmetrically arranged pull rods; the other ends of the pull rods are hinged to cross rods; and the cross rods are fixedly mounted at the upper part of the first bed frame.

As a preferred solution of the present disclosure, the second angle adjustment driver includes a second electric push rod; a far end of a piston rod of the second electric push rod is hinged with an assembling seat I; one end of a cylinder body of the second electric push rod is hinged with an assembling seat I; one end of the assembling seat I away from the second electric push rod is fixedly connected to the bottom of the middle connecting bed plate; and one end of the assembling seat II away from the second electric push rod is fixedly connected to the bottom of the supporting frame I.

As a preferred solution of the present disclosure, a switch power supply is fixedly mounted at the bottom of the middle connecting bed plate; and the switch power supply is electrically connected to the first electric push rod and the second electric push rod respectively.

As a preferred solution of the present disclosure, steel wire gauzes for supporting are fixedly mounted at an upper part of the middle connecting bed plate, an upper part of the first movable bed plate, an upper part of the supporting frame I, and an upper part of the supporting frame II.

As a preferred solution of the present disclosure, supporting legs are fixedly mounted at a bottom of the middle connecting bed plate, a bottom of the first bed frame, and a bottom of the second bed frame.

As a preferred solution of the present disclosure, supporting blocks configured to support the first movable bed plates and the second movable bed plates are fixedly mounted on both the first bed frame and the second bed frame.

As a preferred solution of the present disclosure, mounting boxes are fixedly mounted at bottoms of the steel wire gauzes for supporting located on the first movable bed plates and bottoms of the steel wire gauzes for supporting located on the supporting frames II; and vibration motors are mounted inside the mounting boxes.

As a preferred solution of the present disclosure, handles are fixedly mounted at outer edges of the first movable bed plates and outer edges of the supporting frames II.

The present disclosure has the following beneficial effects:

According to the adjustable bed provided by the present disclosure, by the arrangement of the at least two groups of first movable bed plates arranged side by side and the at least two groups of second movable bed plates arranged side by side, and due to the independent adjustment on inclination angles of each group of first movable bed plates and each group of second movable bed plates, the adjustable bed can use needs of at least two persons at the same time, and has good practicality.

Figure 1:
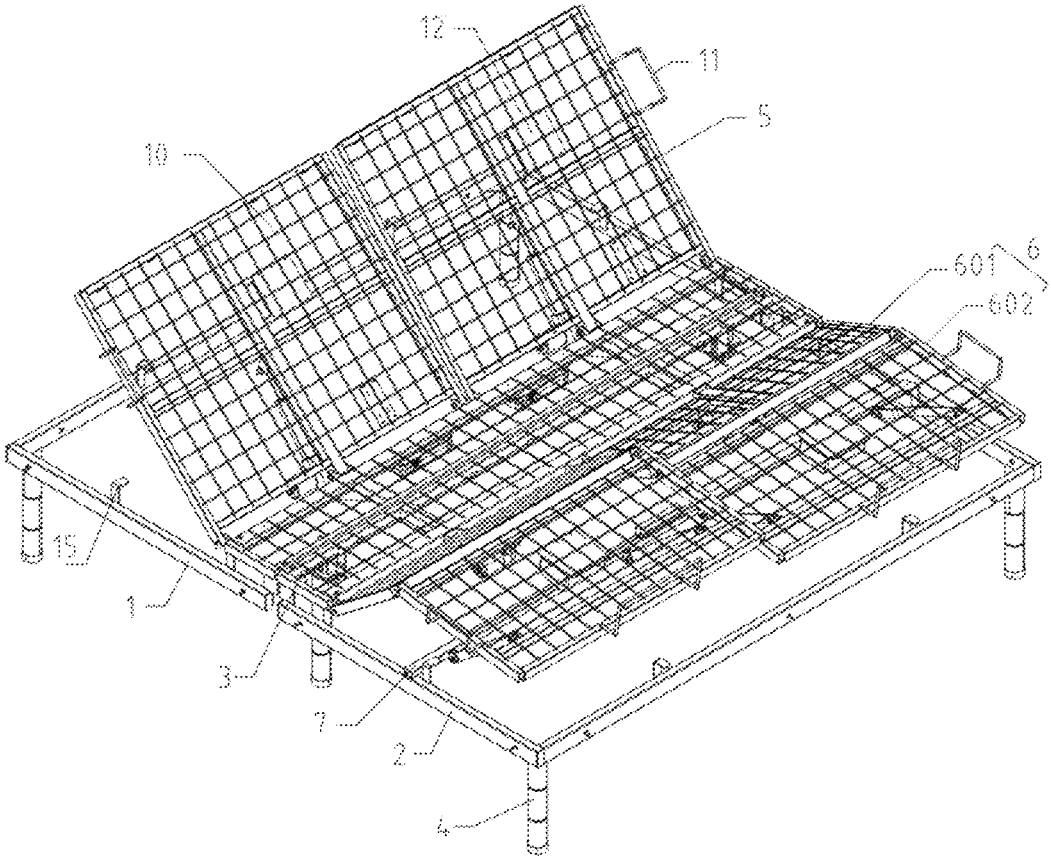
FIG. 1 is a schematic structural diagram of an adjustable bed according to an embodiment of the present disclosure.

1: first bed frame; 2: second bed frame; 3: middle connecting bed plate; 4: supporting leg; 5: first movable bed plate; 6: second movable bed plate; 601: supporting frame I; 602: supporting frame II; 7: cross rod; 8: first electric push rod; 801: connecting seat I; 802: connecting seat II; 9: second electric push rod; 901: assembling seat I; 902: assembling seat II; 10: steel wire gauze for supporting; 11: handle; 12: mounting box; 13: switch power supply; 14: pull rod; and 15: supporting block.

DETAILED DESCRIPTION OF THE EMBODIMENTS

The technical solutions of the present disclosure will be further explained below in conjunction with the accompanying drawings and specific implementations.

The accompanying drawings are only for illustrative purposes and represent only schematic diagrams, not physical diagrams. They cannot be understood as a limitation on this patent. To better explain the embodiments of the present disclosure, some components in the accompanying drawings may be omitted, enlarged, or reduced, which does not represent a size of an actual product. For those skilled in the art, it can be understood that some well-known structures and their explanations in the accompanying drawings may be omitted.

The identical or similar numerals in the accompanying drawings in this embodiment correspond to identical or similar components. In the description of the present disclosure, it should be understood that orientations or positional relationships indicated by the terms "upper", "lower", "left", "right", "inner", "outer", and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms for describing the positional relationships in the accompanying drawings are only used for exemplary illustrations and are not construed as limiting the present disclosure. A person of ordinary skill in the art can understand the specific meanings of the above terms according to specific situations.

In the description of the present disclosure, unless otherwise expressly specified and limited, in case of a term "connection" that indicates connection relationships between components, the term should be understood in a broad sense, such as, a fixed connection, a detachable connection, an integrated connection, a mechanical connection, an electrical connection, a direct connection, an indirect connection through an intermediate medium, an internal communication of two components, or interaction between two components. For those of ordinary skill in the art, the specific meanings of the aforementioned terms in the present disclosure can be understood based on specific conditions.

Embodiments

Figure 2:
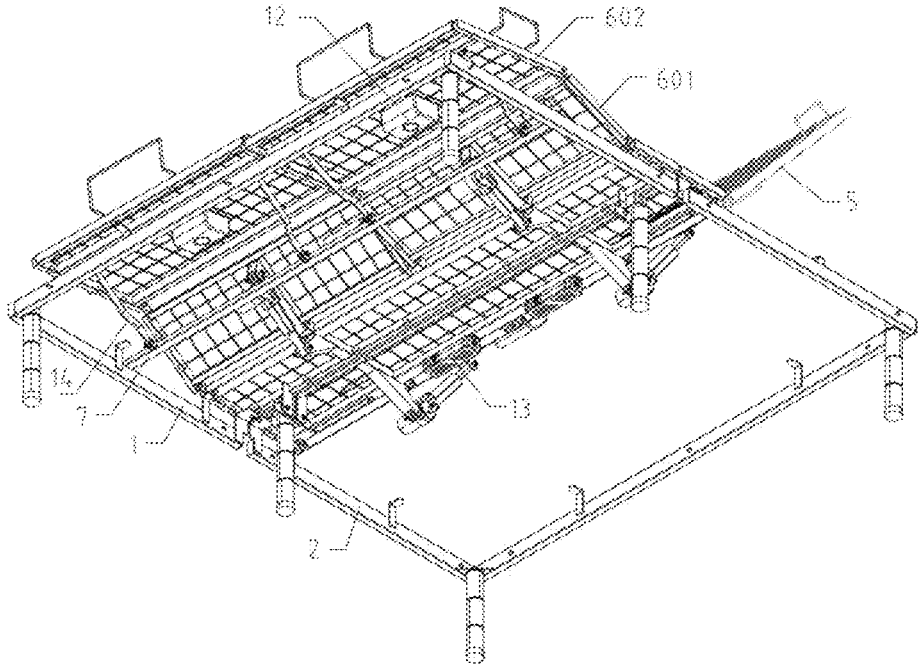
FIG. 2 is a schematic structural diagram of an adjustable bed in another viewing angle according to an embodiment of the present disclosure.
Figure 3:
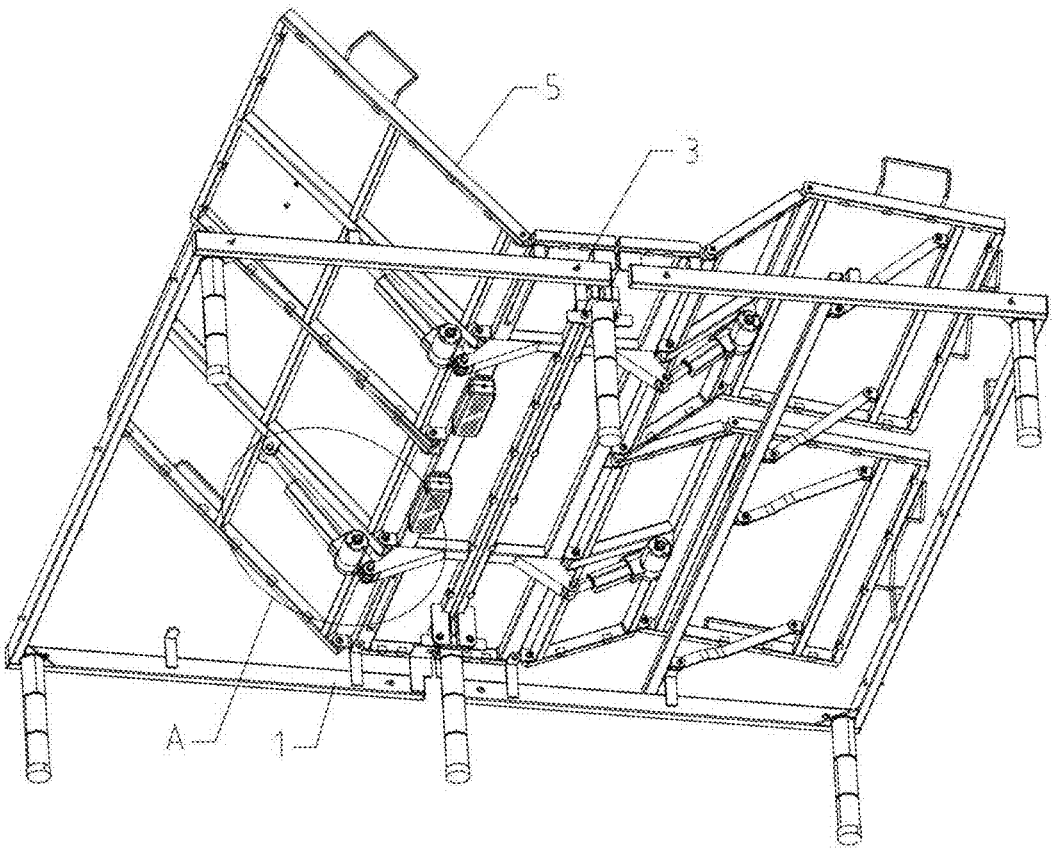
FIG. 3 is a schematic structural diagram of an adjustable bed according to an embodiment of the present disclosure after removing steel wire gauzes for supporting.
Figure 4:
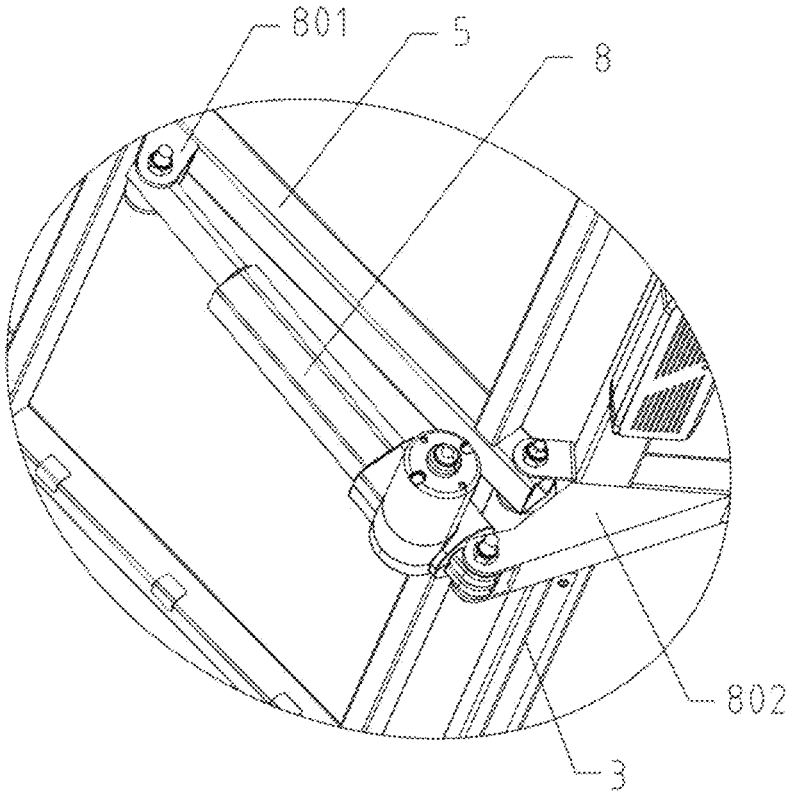
FIG. 4 is a schematic diagram of an enlarged structure of part A in FIG. 3.
Figure 5:
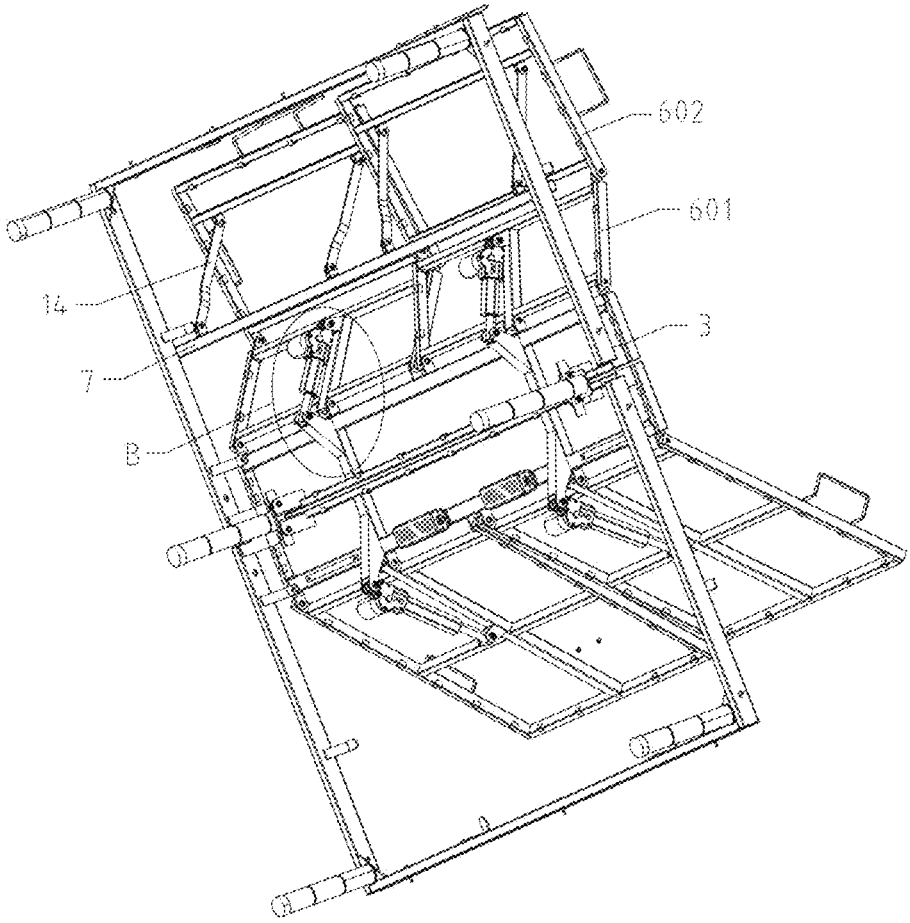
FIG. 5 is a schematic structural diagram of an adjustable bed in another viewing angle according to an embodiment of the present disclosure after removing steel wire gauzes for supporting.
Figure 6:
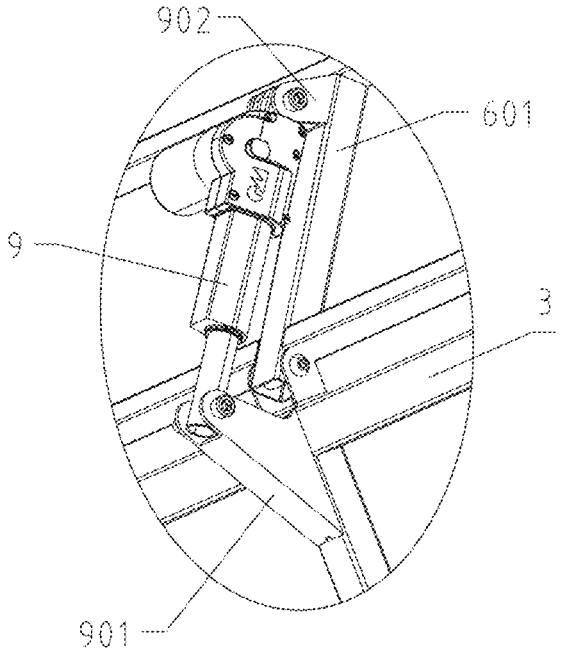
FIG. 6 is a schematic diagram of an enlarged structure of part B in FIG. 5.
Figure 7:
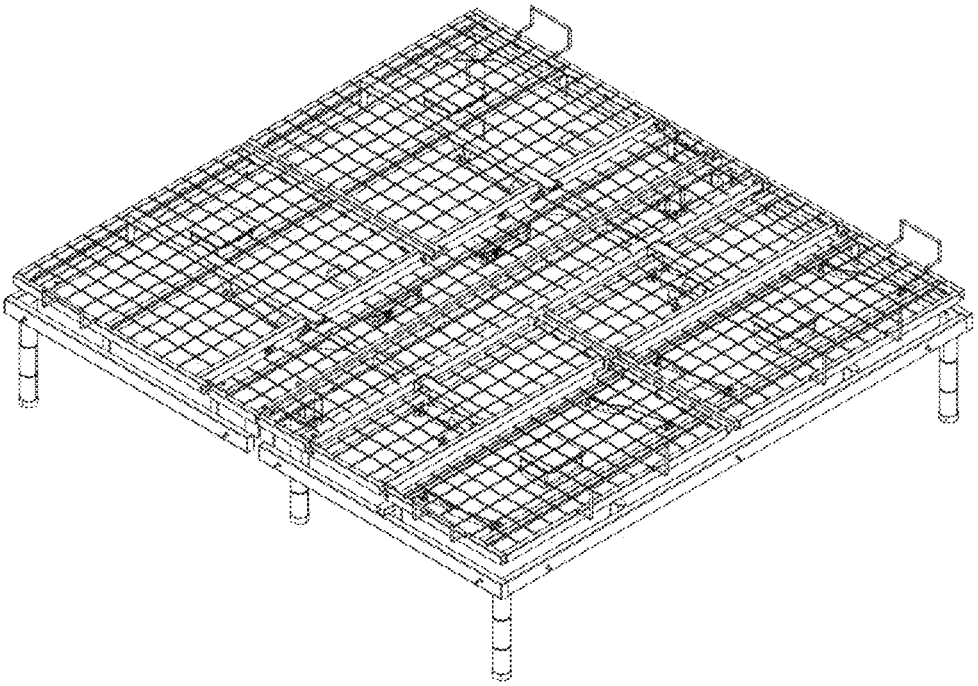
FIG. 7 is a schematic state diagram I of an adjustable bed according to an embodiment of the present disclosure.
Figure 8:
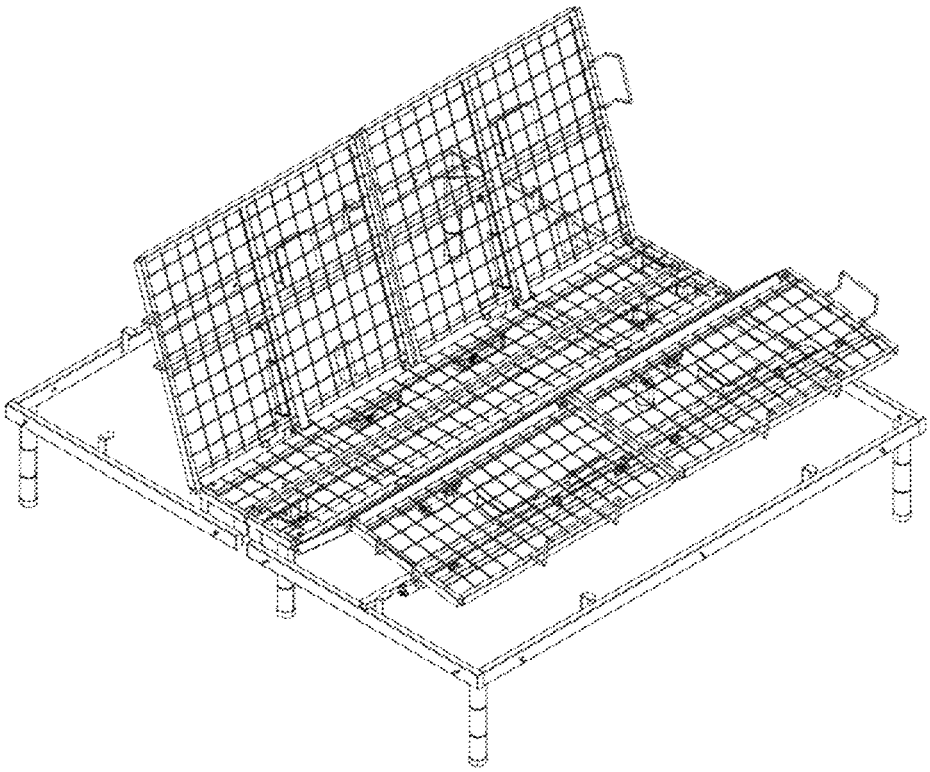
FIG. 8 is a schematic state diagram II of an adjustable bed according to an embodiment of the present disclosure.
Figure 9:
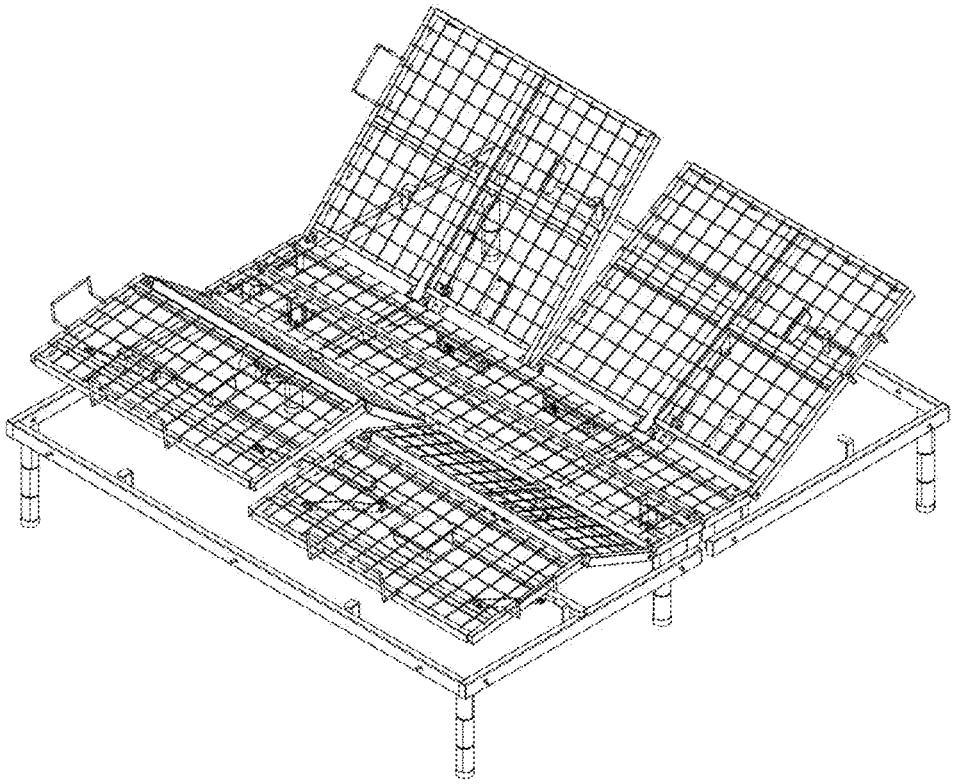
FIG. 9 is a schematic state diagram III of an adjustable bed according to an embodiment of the present disclosure.

As shown in FIG. 1 to FIG. 9, an adjustable bed provided in this embodiment includes: a middle connecting bed plate 3. A first bed frame 1 and a second bed frame 2 are fixedly mounted at a bottom of the middle connecting bed plate 3, and the second bed frame 2 and the first bed frame 1 form a square framework.

At least two groups of first movable bed plates 5 arranged side by side are mounted at an upper part of the first bed frame 1; one end of each first movable bed plate 5 is hinged to the middle connecting bed plate 3; and a first angle adjustment driver is hinged between a bottom of each first movable bed plate 5 and the bottom of the middle connecting bed plate 3. The first movable bed plates 5 are configured to support the upper body of a user, and the first angle adjustment driver is configured to adjust an inclination angle of the first movable bed plate 5, to meet use needs of different users.

At least two groups of second movable bed plates 6 arranged side by side are mounted at an upper part of the second bed frame 2; one end of each second movable bed plate 6 is hinged to the middle connecting bed plate 3; and a second angle adjustment driver is hinged between a bottom of each second movable bed plate 6 and the bottom of the middle connecting bed plate 3. The second movable bed plates 6 are configured to support the lower body of a user, and the second angle adjustment driver is configured to adjust an inclination angle of the second movable bed plate 6, to meet use needs of different users.

By the arrangement of the at least two groups of first movable bed plates 5 arranged side by side and the at least two groups of second movable bed plates 6 arranged side by side, and due to the independent adjustment on the inclination angles of each group of first movable bed plates 5 and each group of second movable bed plates 6, the adjustable bed can use needs of at least two persons at the same time, and has good practicality.

Specifically, in this embodiment, the first angle adjustment driver includes a first electric push rod 8; a far end of a piston rod of the first electric push rod 8 is hinged with a connecting seat I 801; one end of a cylinder body of the first electric push rod 8 is hinged with a connecting seat II 802; one end of the connecting seat I 801 away from the first electric push rod 8 is fixedly connected to a middle part of each first movable bed plate 5; and one end of the connecting seat II 802 away from the first electric push rod 8 is fixedly connected to the bottom of the middle connecting bed plate 3. The arranged first electric push rod 8 is configured to adjust the inclination angle of the first movable bed plate 5.

Specifically, in this embodiment, each second movable bed plate 6 is of a foldable structure, and each second movable bed plate 6 includes a supporting frame I 601 and a supporting frame II 602; one end of the supporting frame I 601 is hinged to the middle connecting bed plate 3; one end of the supporting frame II 602 is hinged to the other end of the supporting frame I 601; a position, close to the other end of each supporting frame II 602, is hinged with two symmetrically arranged pull rods 14; the other ends of the pull rods 14 are hinged to cross rods 7; and the cross rods 7 are fixedly mounted at the upper part of the first bed frame 1. The second movable bed plate 6 arranged is formed by hinging the supporting frame I 601 and the supporting frame II 602, so that the second movable bed plate 6 can be folded. The supporting frame I 601 arranged is configured to support the thighs of a user. The supporting frame II 602 arranged is configured to support the lower legs of the user. This conforms to the ergonomic design and has good comfort.

Specifically, in this embodiment, the second angle adjustment driver includes a second electric push rod 9; a far end of a piston rod of the second electric push rod 9 is hinged with an assembling seat I 901; one end of a cylinder body of the second electric push rod 9 is hinged with an assembling seat I 902; one end of the assembling seat I 901 away from the second electric push rod 9 is fixedly connected to the bottom of the middle connecting bed plate 3; and one end of the assembling seat II 902 away from the second electric push rod 9 is fixedly connected to the bottom of the supporting frame I 601. The second electric push rod 9 arranged is configured to adjust the inclination angle of the supporting frame I 601. Under the action of the pull rods 14 and the cross rods 7, discomfort of a user in the lower legs caused by the fact that one end of the supporting frame II 602 away from the supporting frame I 601 is raised excessively can be avoided.

Specifically, in this embodiment, a switch power supply 13 is fixedly mounted at the bottom of the middle connecting bed plate 3; and the switch power supply 13 is electrically connected to the first electric push rod 8 and the second electric push rod 9 respectively. The switch power supply 13 arranged is configured to be connected to a mains supply to respectively supply power to the first electric push rod 8 and the second electric push rod 9.

Specifically, in this embodiment, to enhance the supporting effect on the body of a user, steel wire gauzes 10 for supporting are fixedly mounted at an upper part of the middle connecting bed plate 3, an upper part of the first movable bed plate 5, an upper part of the supporting frame I 601, and an upper part of the supporting frame II 602. The steel wire gauzes 10 for supporting are configured to support the body of the user, which can improve the comfort level.

Specifically, in this embodiment, to facilitate the stable placement of the adjustable bed on the ground, supporting legs 4 are fixedly mounted at a bottom of the middle connecting bed plate 3, a bottom of the first bed frame 1, and a bottom of the second bed frame 2.

Specifically, in this embodiment, to make the first bed frame 1 and the second bed frame 2 stably stand when they are flatly placed, supporting blocks 15 configured to support the first movable bed plates 5 and the second movable bed plates 6 are fixedly mounted on both the first bed frame 1 and the second bed frame 2.

Specifically, in this embodiment, to facilitate the mounting of vibration motors to perform vibration massage on a user, mounting boxes 12 are fixedly mounted at bottoms of the steel wire gauzes 10 for supporting located on the first movable bed plates 5 and bottoms of the steel wire gauzes 10 for supporting located on the supporting frames II 602; and vibration motors are mounted inside the mounting boxes 12. The vibration motors arranged can achieve the vibration massage on the user.

Specifically, in this embodiment, to facilitate a user to hold the product, handles 11 are fixedly mounted at outer edges of the first movable bed plates 5 and outer edges of the supporting frames II 602.

In summary, the adjustable bed provided in this embodiment has the following advantages:

By the arrangement of the at least two groups of first movable bed plates 5 arranged side by side and the at least two groups of second movable bed plates 6 arranged side by side, and due to the independent adjustment on the inclination angles of each group of first movable bed plates 5 and each group of second movable bed plates 6, the adjustable bed can use needs of at least two persons at the same time, and has good practicality.

During use, soft cushions sleeve the first movable bed plates 5 and the second movable bed plates 6; slots are provided in centers of two ends of the soft cushions to avoid interference with the independent adjustment of the inclination angles of each group of first movable bed plates 5 and the inclination angles of each group of second movable bed plates 6. According to a need, a user can control the first electric push rods 8 to adjust the inclination angles of the first movable bed plates 5 and control the second electric push rods 9 to adjust the inclination angles of the supporting frames I 601, to meet different use needs. What is particularly important is that different use needs of at least two persons can be met at the same time.

The above only describes the preferred embodiments of the present disclosure and does not limit the implementations and protection scope of the present disclosure. A person skilled in the art should realize that solutions obtained by equivalent replacements and obvious changes that are made according to the specification of the present disclosure and content shown shall all fall within the protection scope of the present disclosure.

What is claimed is:

1. An adjustable bed, comprising:

a middle connecting bed plate (3), wherein a first bed frame (1) and a second bed frame (2) are fixedly mounted at a bottom of the middle connecting bed plate (3), and the second bed frame (2) and the first bed frame (1) form a square framework;

at least two groups of first movable bed plates (5) arranged side by side are mounted at an upper part of the first bed frame (1); one end of each first movable bed plate (5) is hinged to the middle connecting bed plate (3); a first angle adjustment driver is hinged between a bottom of each first movable bed plate (5) and the bottom of the middle connecting bed plate (3);

at least two groups of second movable bed plates (6) arranged side by side are mounted at an upper part of the second bed frame (2); one end of each second movable bed plate (6) is hinged to the middle connecting bed plate (3); and a second angle adjustment driver is hinged between a bottom of each second movable bed plate (6) and the bottom of the middle connecting bed plate (3);

wherein the first angle adjustment driver comprises a first electric push rod (8); a far end of a piston rod of the first electric push rod (8) is hinged with a connecting seat I (801); one end of a cylinder body of the first electric push rod (8) is hinged with a connecting seat II (802); one end of the connecting seat I (801) away from the first electric push rod (8) is fixedly connected to a middle part of each first movable bed plate (5); and one end of the connecting seat II (802) away from the first electric push rod (8) is fixedly connected to the bottom of the middle connecting bed plate (3);

wherein each second movable bed plate (6) is of a foldable structure, and each second movable bed plate (6) comprises a supporting frame I (601) and a supporting frame II (602); one end of the supporting frame I (601) is hinged to the middle connecting bed plate (3); one end of the supporting frame II (602) is hinged to the other end of the supporting frame I (601); a position, close to the other end of each supporting frame II (602), is hinged with two symmetrically arranged pull rods (14); the other ends of the pull rods (14) are hinged to cross rods (7); and the cross rods (7) are fixedly mounted at the upper part of the first bed frame (1).

2. The adjustable bed according to claim 1, wherein the second angle adjustment driver comprises a second electric push rod (9); a far end of a piston rod of the second electric push rod (9) is hinged with an assembling seat I (901); one end of a cylinder body of the second electric push rod (9) is hinged with an assembling seat I (902); one end of the assembling seat I (901) away from the second electric push rod (9) is fixedly connected to the bottom of the middle connecting bed plate (3); and one end of the assembling seat II (902) away from the second electric push rod (9) is fixedly connected to the bottom of the supporting frame I (601).

3. The adjustable bed according to claim 2, wherein a switch power supply (13) is fixedly mounted at the bottom of the middle connecting bed plate (3); and the switch power supply (13) is electrically connected to the first electric push rod (8) and the second electric push rod (9) respectively.

4. The adjustable bed according to claim 2, wherein steel wire gauzes (10) for supporting are fixedly mounted at an upper part of the middle connecting bed plate (3), an upper part of the first movable bed plate (5), an upper part of the supporting frame I (601), and an upper part of the supporting frame II (602).

5. The adjustable bed according to claim 4, wherein supporting legs (4) are fixedly mounted at a bottom of the middle connecting bed plate (3), a bottom of the first bed frame (1), and a bottom of the second bed frame (2).

6. The adjustable bed according to claim 5, wherein supporting blocks (15) configured to support the first movable bed plates (5) and the second movable bed plates (6) are fixedly mounted on both the first bed frame (1) and the second bed frame (2).

7. The adjustable bed according to claim 6, wherein mounting boxes (12) are fixedly mounted at bottoms of the steel wire gauzes (10) for supporting located on the first movable bed plates (5) and bottoms of the steel wire gauzes (10) for supporting located on the supporting frames II (602); and vibration motors are mounted inside the mounting boxes (12).

8. The adjustable bed according to claim 1, wherein handles (11) are fixedly mounted at outer edges of the first movable bed plates (5) and outer edges of the supporting frames II (602).

* * * * *